United States Patent [19]

Looker et al.

[11] 4,158,985

[45] Jun. 26, 1979

[54] METHOD AND APPARATUS FOR FORMING IMPROVED NETS

[75] Inventors: Robert Looker, Carpinteria; Richard E. McLennan, Rancho Palos Verdes, both of Calif.

[73] Assignee: Satron, Inc., El Segundo, Calif.

[21] Appl. No.: 789,812

[22] Filed: Apr. 22, 1977

Related U.S. Application Data

[63] Continuation of Ser. No. 643,341, Dec. 22, 1975, abandoned.

[51] Int. Cl.[2] ..... D04G 1/02

[52] U.S. Cl. ..... 87/12; 87/53; 289/1.5; 289/18 R

[58] Field of Search ..... 87/12, 53; 289/1.5, 289/2–4, 17, 18, 1.2; 43/7–14

[56] References Cited

U.S. PATENT DOCUMENTS

| | | | |
|---|---|---|---|
| 4,707 | 8/1846 | Moulton | 87/53 |
| 4,707 | 8/1846 | Moulton | 87/53 |
| 36,499 | 9/1862 | Arnold | 87/53 |
| 1,144,733 | 6/1915 | De Sereville | 87/53 |
| 1,974,977 | 9/1934 | Widmann | 87/53 |
| 1,978,103 | 10/1934 | Croasdale, Jr. et al. | 289/1.5 X |
| 2,194,865 | 3/1940 | Mizugoshi | 87/12 |
| 2,194,865 | 3/1940 | Mizugoshi | 87/12 |
| 2,659,956 | 11/1953 | Lilienfeld | 87/12 X |
| 2,711,116 | 6/1955 | Johnson | 87/53 |
| 2,760,402 | 8/1956 | Ederer | 87/53 |
| 2,783,524 | 3/1957 | Branchu et al. | 87/12 X |
| 3,091,834 | 6/1963 | Pedley et al. | 289/1.2 X |
| 3,307,864 | 3/1967 | Rosenzweig | 289/1.2 |

*Primary Examiner*—John Petrakes

*Attorney, Agent, or Firm*—Smyth, Pavitt, Siegemund, Jones & Martella

[57] ABSTRACT

Improved structural nets for cargo and the like are formed on a fixture including a knot forming matrix including a plurality of knot loop stations arranged in a predetermined orientation and cooperating with loop forming section disposed peripherally of the matrix. By forming a plurality of knot loops in sequence in a plurality of rows, each of which is in a predetermined x-y orientation, the manipulative operations for forming a plurality of hand tied knots is simplified. An inserted tension member is fed through each of the knot loops and the latter are tightened to form knots at the crossing point of the tension members.

24 Claims, 12 Drawing Figures

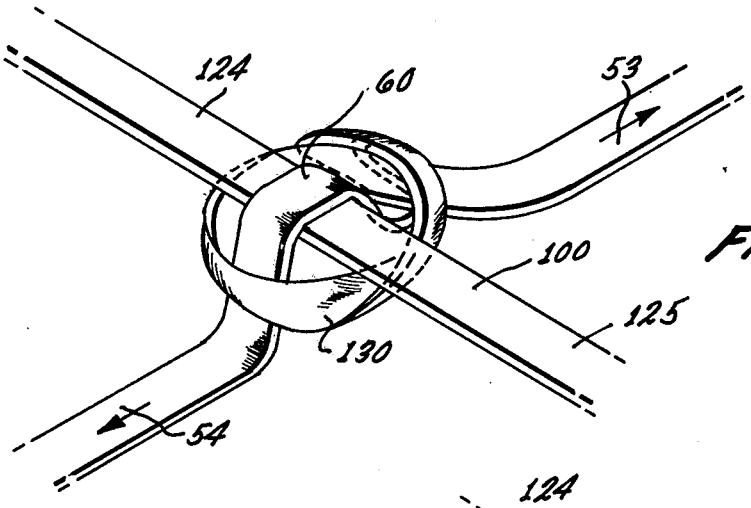
FIG. 9
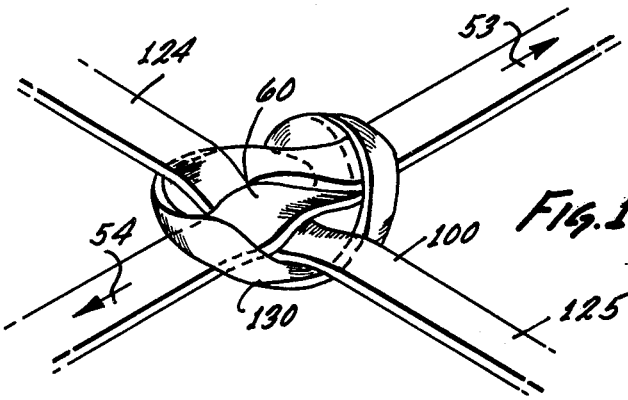
FIG. 10
FIG. 11
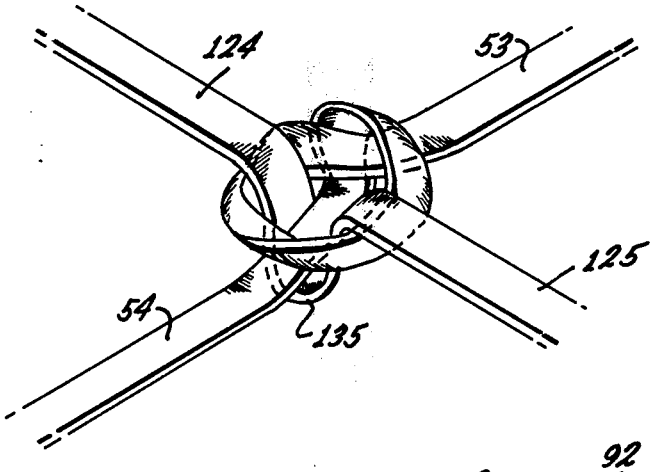
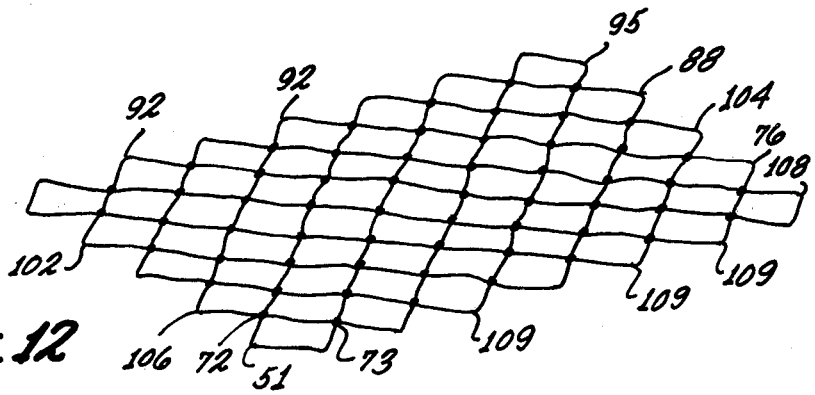
FIG. 12

METHOD AND APPARATUS FOR FORMING IMPROVED NETS

This is a continuation of application Ser. No. 643,341 filed Dec. 22, 1975 now abandoned.

BACKGROUND OF THE INVENTION

This invention relates to a method and apparatus for forming structural nets and more specifically to an improved method for hand tying nets through the use of an improved fixture resulting in a much improved net structure.

DESCRIPTION OF THE PRIOR ART

Structural nets have been known and used for various purposes, restraining nets, cargo slings, safety nets, cargo nets for aircraft cargo retaining equipment, cargo nets for loading and unloading cargo and the like. Normally these nets are formed of tension members in the form of rope of a diameter of 5/16 of an inch or greater depending on the loads to which the net is to be exposed.

For many years these nets were made by hand tying the cross-members making up the net, a laborious and expensive operation. In the case of nets used in air cargo restraint equipment, or as safety or restraint nets in aircraft, many nets presently are made of flat webbing which is sewn together at the crossing points of the nets. Flat webbing is used because of the expense in knotting the cross rope members, which are not made by machine because of the diameter of the rope needed to provide the desired strength. Cross-web nets suffer from the disadvantage that the sewing tends to fix the orientation of the cross-webs, and in itself is a laborious, time consuming and costly process. If in use the cross-webs are displaced from the sewn orientation, the sewing is stressed and may become torn such that the crossing relation of the webs is not maintained. The displacement of the cross-webs or any cross-member occurs as a result of odd size cargo which may project beyond the adjacent cargo items, as well as deflection under load of the net causing a changing angular relationship of the opening of the net.

In those instances in which nets are made of rope, in one instance, the present practice with respect to rope of sufficient strength to be used as a restraining net, cargo net or safety net is to use a clamp at the crossing points of the rope, the clamping including four legs each of which engages one of the rope legs. The cruciform clamp is usually in two halves, each of cruciform shape, which are assembled over the crossing rope members and thereafter joined together to hold the ropes in place in the legs. This also represents a relatively expensive procedure and the rope members are not engaged or secured one to the other by a device or the like the strength of which approaches the strength of a knot.

Crossing rope members have also been held together by binding the ropes at the crossing points by a separate small diameter strand and coating the resultant joint with epoxy or other type of adhesive. Such a procedure is relatively expensive but permits the fabrication of rope nets in which the rope members are free to articulate in the context of forming a joint in which the members are free to move relative to the joint formed by the knot or secured crossing member without excessive stresses at the joint or knot. In fact, this is one of the principal advantages of rope nets with knotted crossing points, the fact that the legs of the joint articulate and conform to odd size cargo items without stressing the joint beyond its limit.

Hand tying or restraining, cargo, and safety nets of rope is costly since it is necessary to pull the whole rope length through the knot as each knot is made. For a net with fifty or more knots, this becomes a time consuming chore. Even if several cross-members are used, the process is still time consuming as the multiple lengths, each of which must be pulled through each knot, are often long for a net of any appreciable size; and results in a net composed of two or more separate pieces of rope, the ends of which must be tied into a net, or spliced therein, a costly process.

The usual knot used for nets of the cargo safety or restraining variety is a sheet bend also known as a becket bend and also called a mesh knot, netting knot, swab knot and weaver's knot. This knot is used because it positively secures the crossing ropes in place and does not slip. The usual practice is so to form such a net that there is a knot at each crossing point of the rope, with the result that a multiplicity of repeating geometrical patterns is formed, e.g. square, rectangular or diamond shaped units, with the knot forming the joint and including four legs extending in an angular relation from each knot.

The problem which presently exists is the expense involved in forming nets of the type described from rope of relatively large diameter as is needed for cargo, restraining and safety nets. While fishing nets, of relatively small diameter rope strands may be formed by automated machines, large diameter rope may not be used in these machines because of the bulk and size of the rope used for nets of the type using rope of 3/16 inch diameter and above, being beyond the usual capacity of net machinery. Also net machinery can only be used to produce continuous netting in a flat, even, ordered shape, analogous to yard goods, and not in any of the specialized shapes often required for nets.

SUMMARY OF THE INVENTION

By the present invention, structural nets are provided by an improved, relatively simple method using an improved net making fixture which allows fabrication of improved structural nets in an inexpensive rapid manner.

The sequence of the method involves arranging a tension member in a plurality of rows each of which includes a plurality of female knot loops arranged in multiple sets in basically an x-y orientation. One of the sets includes alternate female knot loops in axial alignment in an x direction and offset in a y direction with respect to the female knot loops of the other set. The female knot loops of the other set are in axial alignment in an x direction.

Adjacent rows of female knot loops are disposed such that one set of female knot loops is in alignment in an x direction with the female knot loops of the adjacent row on one side while the other female knot loops of the row are displaced in a y direction and in alignment with the female knot loops in an x direction.

After the rows of knot loops have been arranged as described, a male tension member is sequentially fed through the female knot loops which are in alignment in an x direction such that the inserted male tension member extends in an x direction through each knot loop. The portion of the inserted male tension member between adjacent female knot loops aligned in an x direction is in a preferred form of the invention, then displaced in a z direction, downwardly, a predetermined distance approximately approaching the distance between the legs which interconnect each knot in the finished net. Thereafter, each knot loop is tightened to form a knot at each female knot loop where the male tension member is inserted through the female knot loop. Each female knot loop is formed by providing a loop including a leading and trailing leg such that the trailing leg leads to the next female knot loop position. The male tension member which is sequentially inserted through the female knot loop includes a leading cross-leg and a trailing cross-leg, the leading and trailing cross-legs being in axial alignment in an x direction.

With the inserted male tension member through the female loop, the female loop portion of the knot loop overlies the inserted male tension member. To tighten the knot, the trailing and leading legs of the female knot loop are pulled relative to each other such that the knot loop is inverted such that the loop is straightened and a loop is formed between the leading and trailing cross-legs of the inserted tension member. As each female knot loop is tightened, the legs between adjacent female knot loops increases in length while the length of the male tension member between adjacent female knot loops decreases in length.

In a preferred form of this invention, all female knot loops of the net are first formed in succession by looping the portion of the rope extending between the previously formed knot loop and the supply of unlooped rope, i.e. a reel of rope. When all the female loops are formed the rope supply reel is unreeled to a predetermined length as necessary to form the male tension member or members, and the rope is there cut. The free end is then fed through the first row of female knot loops and is all hand pulled through each multiple pattern. The tension member is then spaced successively in a Z direction, as necessary for proper spacing, by hand, the rope necessary for the spacing travelling in a reverse direction through the female knot loops of the next row, and so on until the net is fully formed.

By the above procedure, each knot forming the crossing points of the net is effectively hand tied in a knot commonly known as a sheet or becket bend. The advantage of a sheet bend type of knot is that it includes four legs extending from the knot while not permitting slippage of any of the legs relative to the knot. Moreover, the legs are free to "articulate" without unduly stressing the tension members in the knot.

In a preferred form of the method, the tension members are composed of nylon rope, and preferably a woven rope as described and claimed in U.S. Application Ser. No. 558,911 filed Mar. 17, 1975, whose disclosure is incorporated herein by reference. The use of a nylon rope has the advantage of permitting the knot to be tightened by treatment with an aqueous medium in which a resin has been dispersed or dissolved. Since nylon shrinks approximately ten percent, treatment with the aqueous resin medium not only creates a shrinkage which tightens the knot but provides an abrasion resistant coating on all portions of the tension member making up the knot and the resulting net.

In a preferred form of this invention, the net is formed of woven rope as described in the above application, or variations thereof. One such variation is a woven tension member composed of a plurality of longitudinally oriented or arranged strands disposed in a circular orientation and held together by a continuous weft strand generally transverse to the warp strands which extend longitudinally. The weft strand is under sufficient tension to hold the warp strands in a circular orientation, so that in cross-section the rope is generally tubular with the warp strands constituting the wall of the tube and the weft operative to hold the assemblage in tubular circular orientation. The warp strands are axially aligned along the longitudinal lay of the rope and free from crossing points between adjacent warp strands. While this type of rope may be squeezed to a flat arrangement, it tends to remain round, because of the tension on the weft strand, and possesses all of the essential qualities of rope, knotability and the like, and substantial strength in tension because the warp strands lay axially along the lay of the rope.

One of the advantages of the method of the present invention is the fact that nets may be made quickly, efficiently, and relatively inexpensively in a variety of forms each dictated by the particular need and easily fabricated by the proper fixture. Thus, the net is made from rope by essentially a hand tying operation which is automated to the extent that the net is laid out and the knots are tied without the necessity of having to pull the entire length of the inserted tension member through each knot as each knot is made. Another advantage of the method of the present invention is the fact that a net may be made of one single tension member in which event the inserted tension member is merely a continuation of that tension member used to form the rows of knot loops. Alternatively, the inserted male tension member may be separate from the member forming the female knot loops in which event the net is composed of not more than two separate members.

In forming the net in accordance with this invention, regardless of whether a single or two tension member is used, the main body portion of the net is composed of repeating geometric patterns of crossing tension members knotted at each crossing point, the periphery of the net including a multiplicity of loops between selected knots. Each loop, or selected portions of the peripheral loops may have affixed thereto cargo fittings such as hooks and the like, readily locatable by passing the free end of the male or female tension members through the appended member thus permanently locating each appended member. In the case of cargo nets used in the air cargo field, the loops may have hooks, stud tie-down fittings for tracks, buckles or any of the other ancillary hardware customarily used with cargo nets in the air cargo field.

In the formation of the net in accordance with the present invention, a unique net fixture is used, the net fixture including a central knot forming matrix made up of a plurality of knot forming stations arranged in any predetermined pattern depending on the size and general arrangement of the net to be made. In general, however, the knot forming matrix is made up of a plurality of knot forming stations arranged in an x-y orientation of rows and columns. Alternate columns are arranged in alignment in a y direction and generally include the same number of knot forming stations. The knot forming stations constituting the rows are in alignment in an x direction. Located a predetermined distance below the knot forming stations, and defining a z deminsion for forming two of the legs between adjacent knots is a base. Located peripherally of the knot forming matrix and positioned in a predetermined relative position with respect to the knot forming stations is a loop forming portion generally arranged in the same plane as the knot forming stations.

In the form described, each knot forming station includes a pair of upstanding spaced fingers such that the tension member may be formed into a knot loop, inserted over the fingers and held in that position in the knot forming matrix. The fingers hold the female knot loop apart such that the inserted male tension member may be inserted between the spaced fingers of each knot forming station. The spacing between adjacent aligned knot stations is less than the dimension of the legs of the geometric pattern making up the central body portion of the net. Thus, the fixture includes an overall dimension in the y direction which is less than the overall dimension in a y direction of the finished net.

In use, a tension member is assembled over each knot forming station in the matrix in a predetermined order and pattern such that the tension member is positioned to form a female knot loop at each knot station while the peripheral loops are formed by passing the tension member around the loop forming points constituting the peripheral region around the knot forming matrix. Thereafter, the inserted male tension member is fed sequentially through each female knot loop in the matrix until the inserted male tension member has been fed through all of the female knot loops formed on the matrix. Thereafter, the portion of the male tension member between adjacent female knot loops is moved downwardly in a z direction to obtain the desired dimension of two of the legs forming the legs emanating from each knot. At this point, the operator may tighten each knot in sequence to provide a finished net which may then be processed as already described. If desired, various fittings may be assembled during the formation of the net by inserting the appropriate fitting as the tension member is positioned in the loop forming region which is peripherally located with respect to the matrix.

One of the principal advantages of the method and the net forming fixture of the present invention is the fact that a substantial variety of geometric patterns and net sizes is easily fabricated by a relatively simple hand tying of knots which does not require that the crossing tension members be pulled through each knot as each knot is tied. Moreover, because of the bulk of the rope used in forming structural nets of the type to which this convention relates, many of the manipulative steps heretofore used in the hand tying of rope nets with knots at each crossing point are substantially eliminated and so vastly simplified that the overall expense of providing a hand tied knotted rope net of sufficient strength to constitute a safety net, a cargo net, or a restraining net is substantially eliminated.

DESCRIPTION OF THE DRAWINGS

FIG. 9 through 11 are a progressive series indicating the steps involved in tightening the knot in accordance with the present invention; and FIG. 12 is a simplified diagram illustrating the general configuration of the net subsequent to its formation and oriented as it would appear when removed from the net fixture in accordance with the present invention.

DETAILED DESCRIPTION OF THE INVENTION

Figure 1:
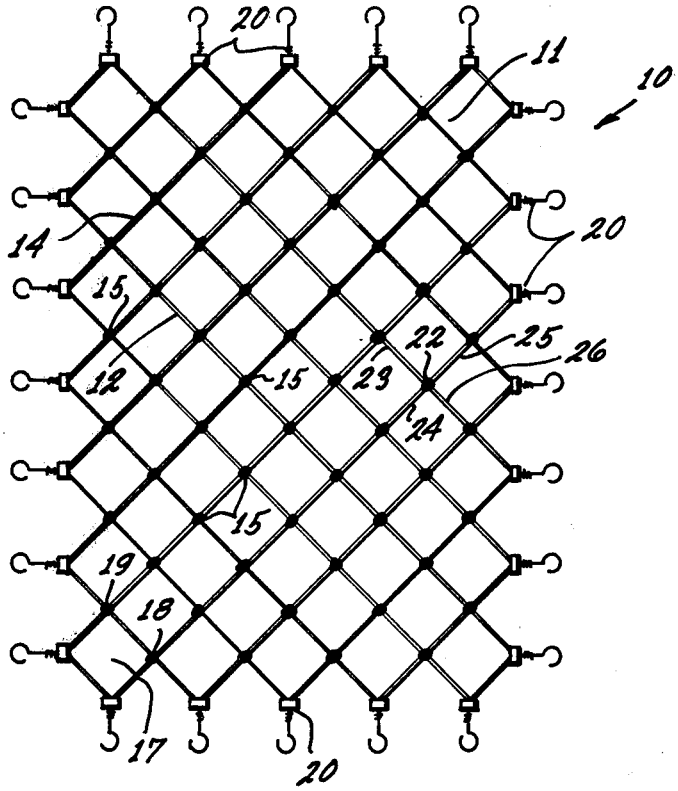
FIG. 1 is a diagrammatic view of a cargo net made by the method in using the fixture of the present invention.

Referring to FIG. 1, a rope net is shown, principally for use in the air cargo field, the net 10 being made up of a main body portion 11 composed of repeating geometric patterns, as illustrated of crossing tension members 12 and 14. Each of the crossing tension members is knotted as indicated at 15 at the crossing points thereof. Located peripherally of the main body portion 11 are a series of loops 17 formed between adjacent knots 18 and 19, each loop including a cargo fitting 20, although it is understood that each loop need not contain a cargo fitting, depending on the needs of the net user.

Each of the knots 15 is preferably a sheet bend knot since this type of knot prevents slippage of the knot with respect to the tension members. Referring specifically to knot 22, for example, the knot includes 4 legs 23, 24, 25, and 26 each of which either constitutes the leg of an adjacent knot or a portion of a loop 17. The net 10 illustrated in FIG. 1 is principally a structural net, that is one whose tension members have substantial strength such that the resulting net may be used as a cargo net, a restraining net, or a safety net. It is understood that the relative size and shape of the net illustrated in FIG. 1 is for purposes of explanation only and that nets made in accordance with the present invention may vary with respect to the number of knots and the overall dimensions of the net. It is also understood that the legs of the knots may be of the same or different dimensions, that is rectangular as opposed to diamond or other shape, as may be desired to meet the requirements of the net user. It is preferred that rope be used in the fabrication of the net and the rope may be of the braided or twisted type, although unique advantage is obtained by using woven rope of nylon, as described in the application previously identified, or as previously described. Webbing may also be used in accordance with this invention.

Figure 2:
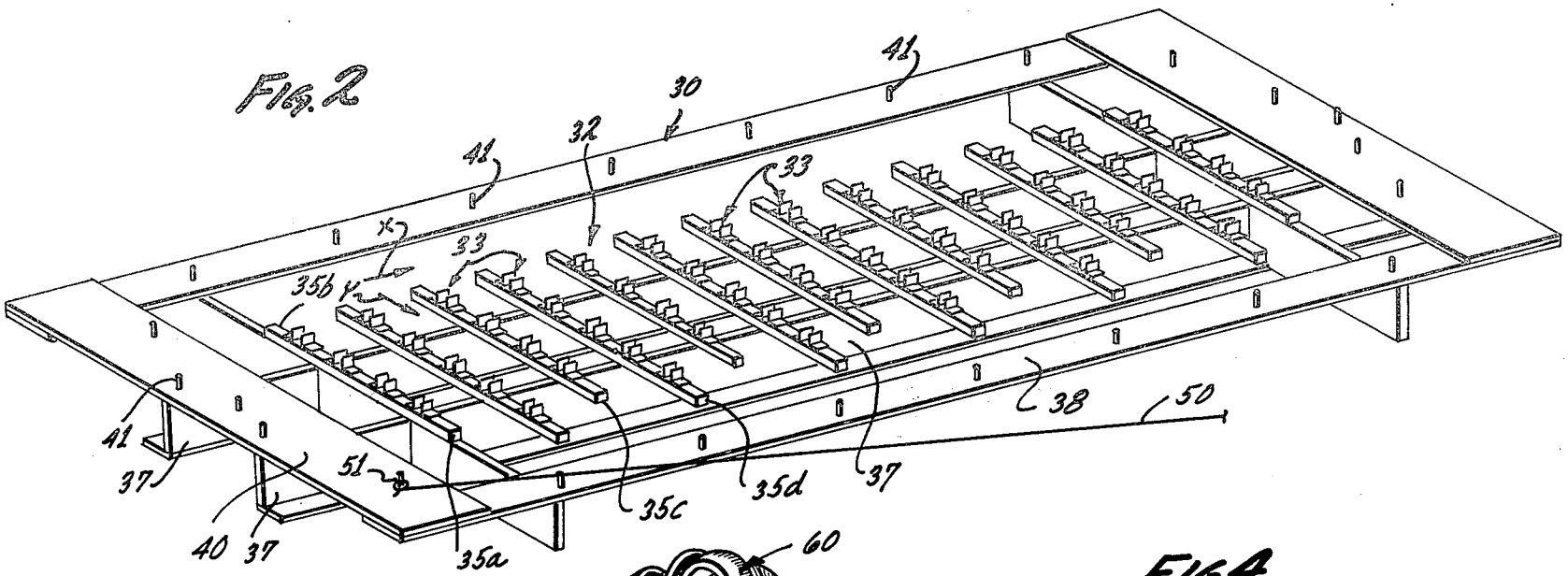
FIG. 2 is a view in perspective of the net fixture in accordance with the present invention.

Referring to FIG. 2, the fixture 30 is used to fabricate structural nets in accordance with the present invention. The fixture principally includes a central knot forming matrix 32 which includes a plurality of knot forming stations 33 arranged in a predetermined pattern which is directly related to the ultimate size and shape of the net to be made and to the spacing of the legs between adjacent knots. Each of the knot forming stations 33 is mounted on a cross-member 35 the latter mounted on vertically extending support elements 37 mounted on the base 38 of the fixture. In this way, each of the knot forming stations is spaced vertically above the base a predetermined distance.

Located peripherally of the knot forming matrix is a loop forming matrix 40 made up of a plurality of loop stations 41 each of which is in a predetermined position relative to a selected knot forming station. The loop forming stations define the unknotted peripheral loop portion of the formed net.

As illustrated in FIG. 2, the knot forming stations are arranged in the matrix in an x-y orientation of rows and columns. The orientation of the columns coincides with the orientation of the cross-member 35, alternate columns 35*a* and 35*c* including the same number of knot stations, but the number of knot stations differing from the stations in alternate columns 35*b* and 35*d*, the latter pair of columns containing the same number of knot stations. As shown, the knot stations of the rows, which extend in an x direction are in alignment, the matrix of rows and columns being positioned a predetermined distance above the base 38 such that the matrix cooperates with the base to define a z dimension for forming the two legs between adjacent knots of the net.

Each of the knot forming stations includes a pair of upstanding spaced fingers 43 and 44, the spacing between the fingers being such as to permit insertion of a male tension member between the fingers as will be described.

At the start of a knot making operation, a tension member 50 from a suitable supply is formed around a loop station 51, as shown in FIG. 2, such that the free end of the tension member is affixed at the first loop station, and the portion of the tension member 50 to the right of the first loop station is used to form a plurality of female knot loops.

Figure 3:
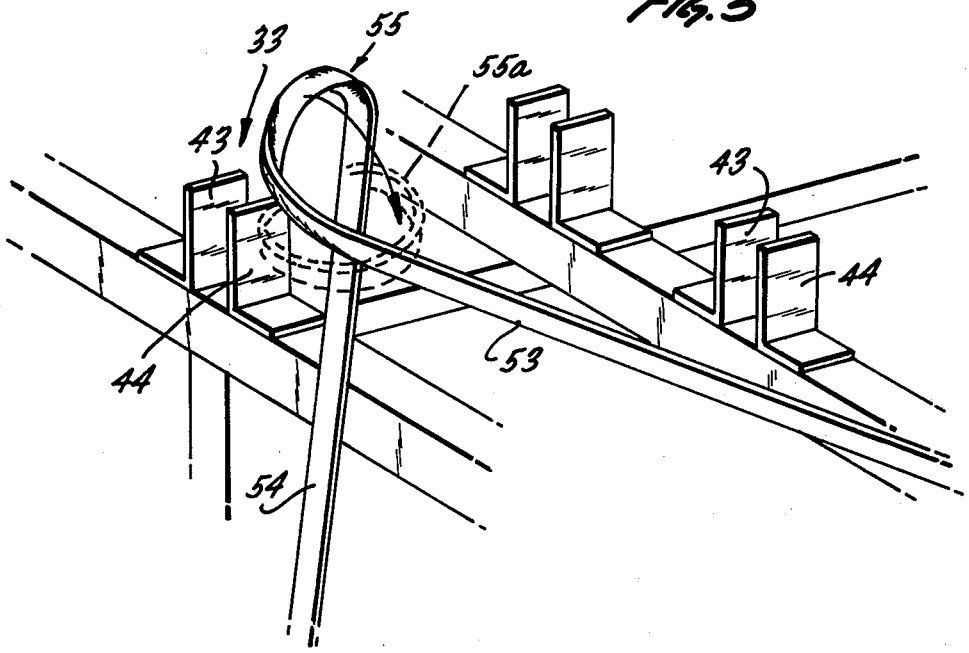
FIG. 3 is an enlarged view illustrating the general sequence at the start of a knot forming loop at the knot forming station in accordance with this invention.
Figure 4:
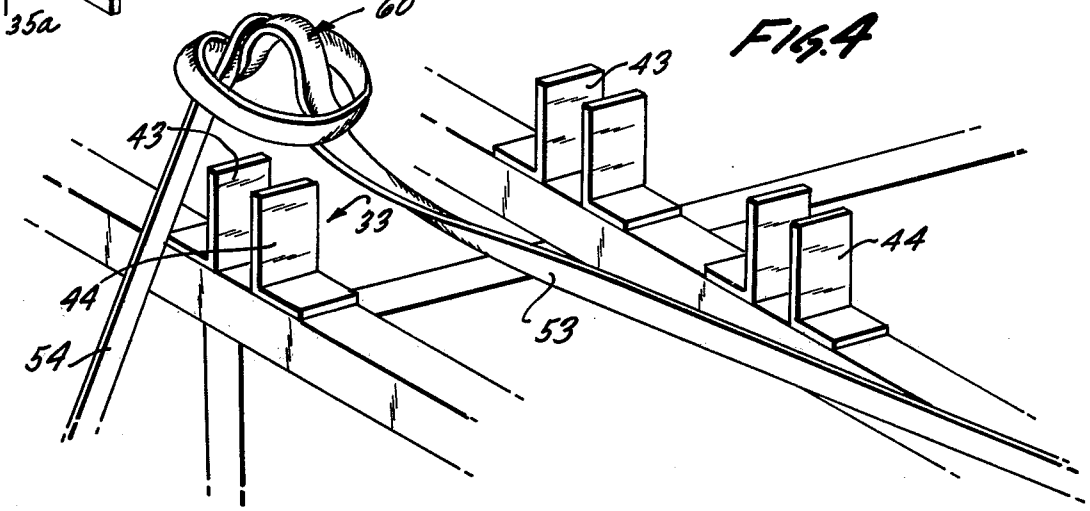
FIG. 4 illustrates the formation of the knot loop in accordance with the present invention.

Referring to FIG. 3, each female knot loop is formed from the tension member by crossing the trailing leg 53 of the tension member over the leading leg 54, the leading leg 54 being secured at a knot loop station 51 (as shown in FIG. 2), the trailing leg 53 leading to the supply of tension member. As shown in FIG. 3, the initial step in forming a female knot loop involves crossing the trailing leg 53 in front of the leading leg 54 such that a basic loop 55 is formed. The basic loop 55 shown in the full line position of FIG. 3 is then moved to the dotted line position 55*a* of FIG. 3 to form a female knot loop arrangement 60 as illustrated in FIG. 4. In the female knot loop form illustrated in FIG. 4, the leading leg 54 and the trailing leg 53 constitute the free ends of the female loop. The female knot loop is then positioned over the spaced fingers of a knot station as indicated in FIG. 5 such that the trailing leg 53 may then be used to form a second female knot loop while the leading leg 54 remains fixed relative to the loop forming station 41.

Figure 5:
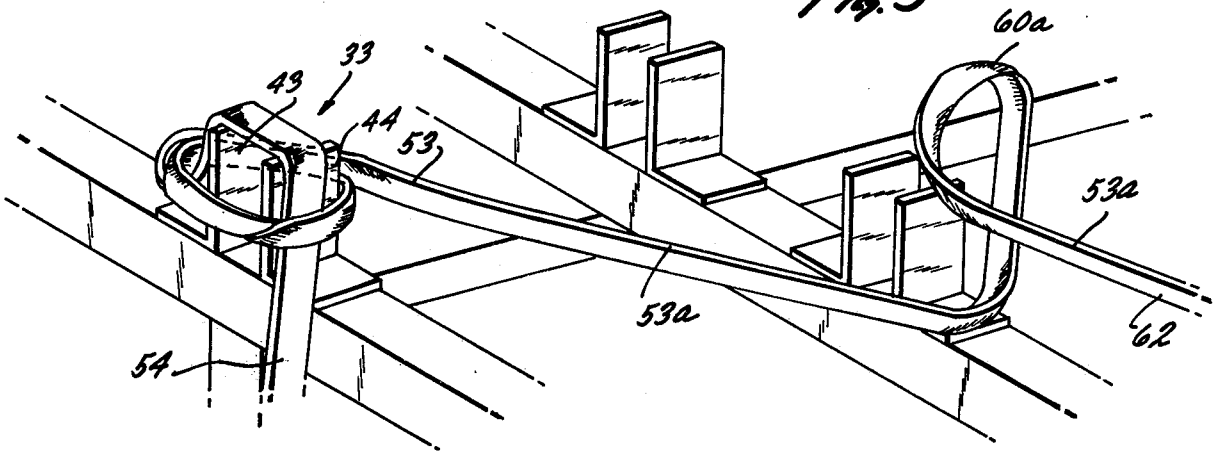
FIG. 5 is a further step in the sequence of forming knot loops in accordance with the present invention.

As illustrated in FIG. 5, a second female knot loop is formed as described, in which the trailing leg 53 constitutes the leading leg 53*a* of a subsequent female knot loop 60*a* while the trailing leg 53*a* represents that portion of the tension member constituting the trailing leg of female knot loop 60*a* and forming the leading leg of subsequent knot. As will be appreciated, the free end of the tension member is held on the loop station 51 and tension members fed from a supply which is on the end 62 of the tension member rather than the fixed end. Thus, as each female knot loop is formed, the worker need not pull the tension member through each knot loop station but merely forms it in sequence at each knot loop station.

Figure 6:
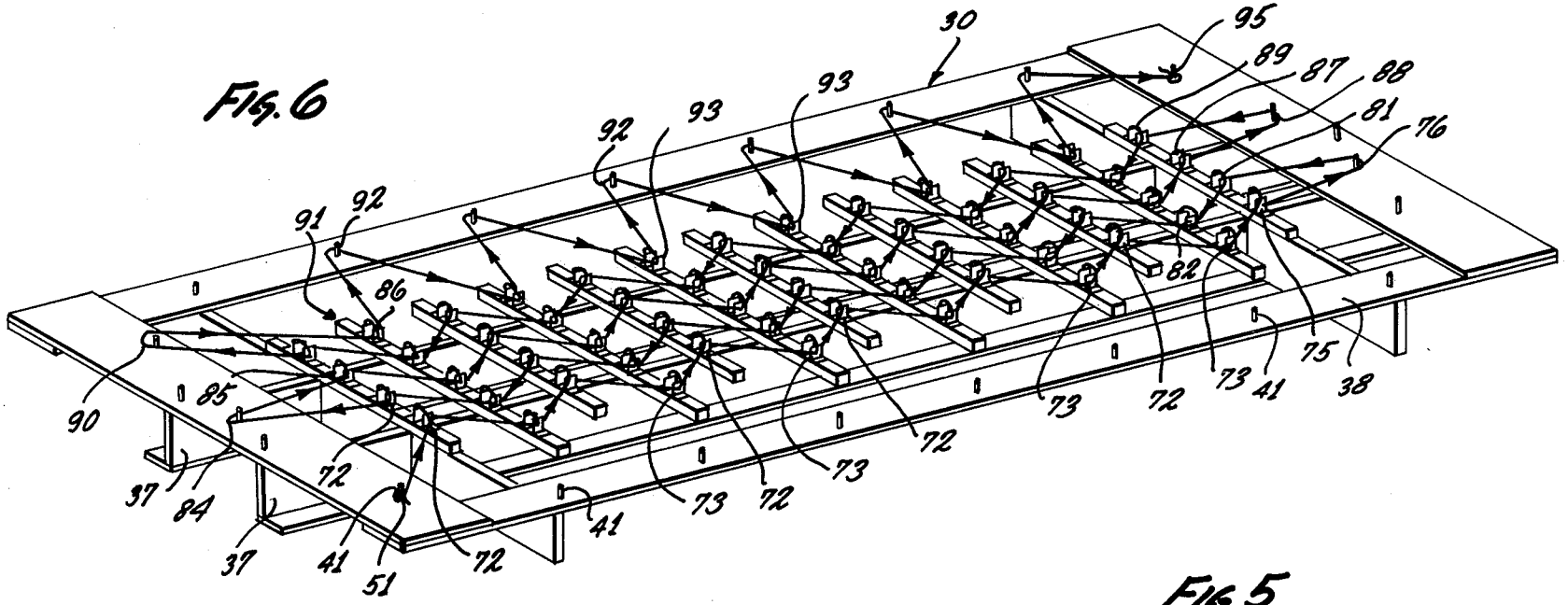
FIG. 6 illustrates the relative position of the female knot loop tension members assembled in proper position on the knot forming stations of the matrix of the net fixture in accordance with the present invention.

Referring to FIG. 6, the free end 51 of the tension member is fixed at station 41 and is arranged over knot loop station 72. After the female knot loop has been formed a second female knot loop is formed at the second station 73 and in similar fashion at each of the stations in the zigzag fashion until the last end station 75 as shown. It will be appreciated that the female knot loops are arranged in a plurality of row sets made up of female knot loops 72 forming one row set and female knot loops 73 forming a second row set, row set 72 constituting female knot loops which are in axial alignment in an x direction but offset in a y direction with respect to the female knot loops 73 of the other row set. Female knot loops 73 are likewise in axial alignment in an x direction but displaced in a y direction relative to the row set 72. From the last knot loop station 75 of the row set 72–73, the tension member is wound around a loop forming station 76 and into the start of a second set of knot loop rows 81 and 82. From the last station of the row set 81–82, the tension member passes around a loop station 84 to the start of a subsequent row set 85–86 to the end station 87 of that row set and around a loop station 88 to still another row set generally designated 89, around a loop station 90 to the final row set 91. The final row set involves positioning the tension member around the peripheral loop stations 92 between adjacent axially aligned knot loop stations 93, and finally around knot loop station 95. As is apparent from FIG. 6, the tension member is one continuous member including a plurality of female knot loops arranged on each of the knot loop stations on the matrix. As each female knot loop is formed, additional tension member may be fed off the supply to form the subsequent female knot loops in sequence as described.

Figure 7:
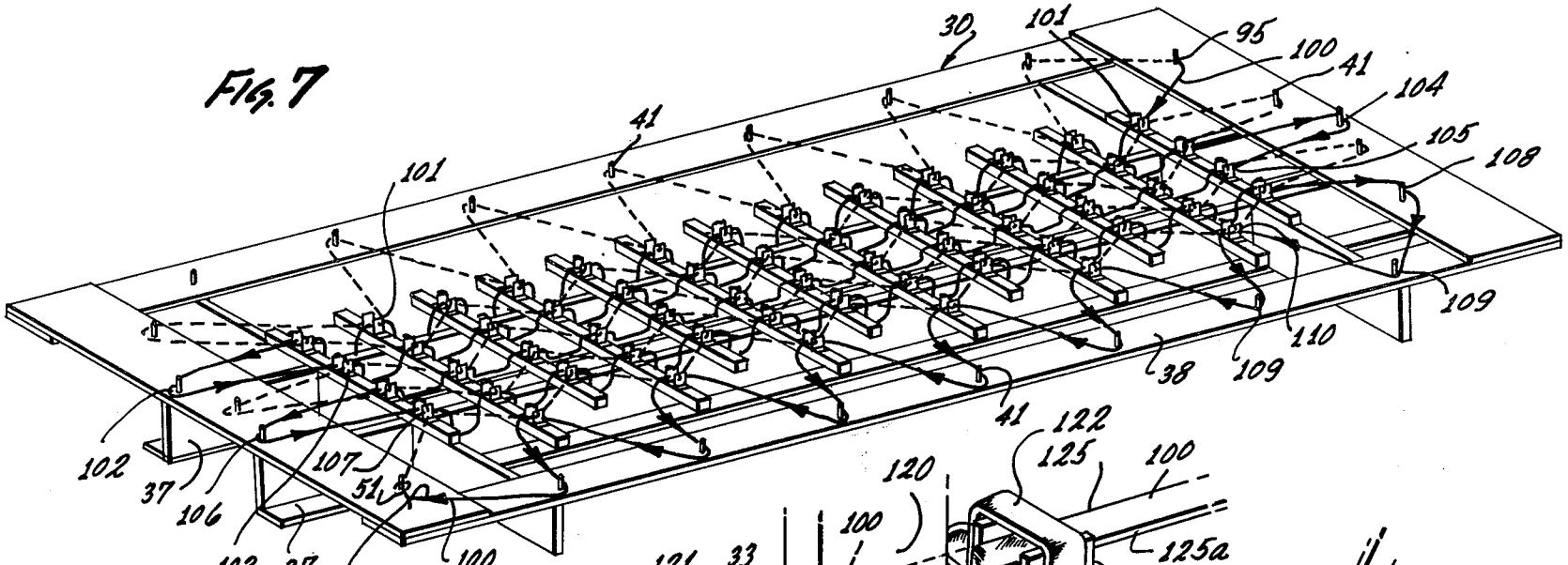
FIG. 7 is similar to FIG. 6 showing the relative position of the inserted male tension members in accordance with the present invention.

Subsequent to formation of the female knot loops, shown in dotted lines in FIG. 7, a second tension member, or the same tension member used to form the knot loops, now known as a male tension member, is then sequentially fed through each of the knot loops supported on the matrix. Thus, referring to FIG. 7, from knot loop station 95, the male tension member is fed through those knot loop stations which are in axial alignment. In the preferred form of the invention, the leading end of the inserted male tension member 100 is fed through all of the knot loops in a row, until the trailing end is in the loops of that row, for example 101, then around the loop forming station 102 and into the second axially aligned row of knot loops 103, around loop station 104 and into the next row 105 around loop station 106 and through the next row 107 and around loop station 108 and thence to a series of loop stations 109 located around the periphery. The loop stations 109 are spaced with an intervening knot loop station 110 between each adjacent pair of loop stations. The free end 115 of the inserted tension member 100 then comes to loop station 51 which was the starting station for the tension member 50. In practice, the worker pulls substantially the entire inserted male tension member through the female knot loops but not tightly, so that a small vertically depending loop exists between adjacent knot loop stations.

Figure 8:
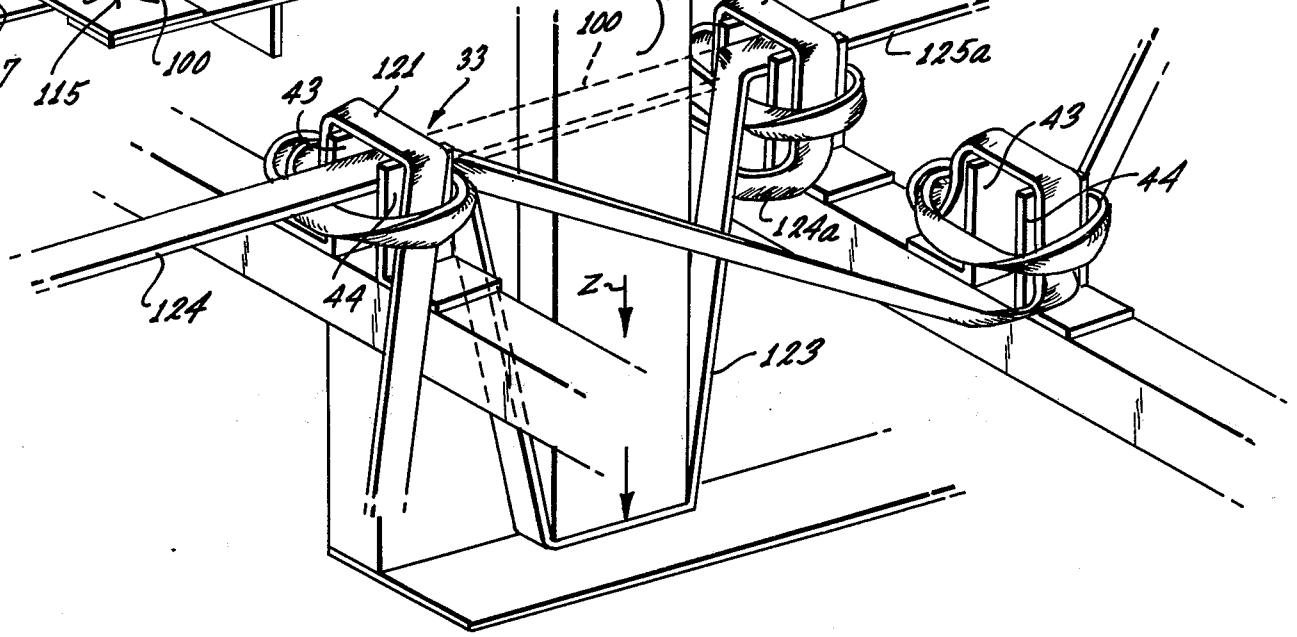
FIG. 8 illustrates the relative sequence involved in moving the portion of the inserted tension member between adjacent knot loops in a z direction during formation of a net in accordance with the present invention.

Referring to FIG. 8, a jig 120 is used to urge the inserted male tension member 100 in a downward vertical z direction between adjacent female knot loops 121 and 122 of each axially aligned row. The formed depending loop 123 constitutes one leg between adjacent knots in the finished net. Since the pattern being described is generally a diamond-shaped pattern, the provision of a vertically downwardly depending loop provides the added length of tension member used to form the diamond-shaped pattern. In sequence, the workman forms a downwardly depending loop between each pair of adjacent knot loop stations in sequence throughout the entire matrix series. Once all of the vertically depending loops 123 have been formed between adjacent knot loop stations, the series of female knot loops with inserted male tension members may be tightened to form the knot. Thus, the inserted male tension member extends in a generally x direction through each of the female knot loops which are in axial alignment. The inserted male tension member includes a leading cross leg 124 and a trailing cross leg 125, the trailing cross leg constituting the leading leg for a subsequent female knot loop and being the portion between adjacent female knot loops which is downwardly looped, as shown in FIG. 8 such that the leading leg **124*a* of female knot loop 122 extends in a generally vertical direction while the trailing leg 125*a*** would likewise extend in a generally vertical direction.

Referring to FIG. 9, the general orientation of the untightened knot is illustrated. As shown, the female knot loop 60 is above the inserted male member 100 with the leading leg 54 in alignment with the trailing leg 53 and the leading cross-leg 124 in alignment with the trailing cross-leg 125. As illustrated, the inserted male tension member 100 passes between the loop 60 and the circular portion 130 of the female knot loop arrangement 60. By pulling on the leading leg 54 of the knot loop relative to the trailing leg, as indicated by the arrows of FIG. 10, the loop is inverted such that the loop 60 is straightened out and a loop 135 (FIG. 11) is formed between the leading and trailing cross legs 124, 125 of the inserted tension member.

The series of FIGS. 9–11 also show that in tightening each knot loop, the length of the tension member between adjacent knots is increased while the length of the inserted male tension member between adjacent knots is decreased. Accordingly, the fixture should be dimensioned to compensate for the effective length changes which take place in the knot tightening sequence.

In the form illustrated, each of the legs 53, 54 and 124 and 125 are arranged in a cruciform arrangement. Thus, the worker progresses down each knot loop, tightening each knot loop as indicated until all knot loops have been tightened in the manner described. The result is the formation of a sheet bend knot at each knot station in which four legs extend from each knot to adjacent knots and/or loops are described.

In the course of formation of the knot, fittings may be inserted at the appropriate points constituting the loops prior to tightening all the knot loops and as the tension member or inserted tension member is fed around the loop forming stations as described. Accordingly, it becomes apparent that it is relatively simple to affix appropriate fittings and the like to the net in a relatively simple manner and to maintain the fittings in position as the net is formed.

It will also be apparent from FIG. 7 that the overall dimensions of the partially completed net are less than the overall dimensions of the net as completed. This is achieved by having vertically depending loops between adjacent knot loop stations and utilizing a zigzag pattern of adjacent displaced row sets as described. Subsequent to tightening all of the knots, the resulting net assumes the configuration illustrated in FIG. 12 in which the starting point is indicated at 51 and the remaining reference numerals correspond essentially to the general location of the corresponding points referring to FIG. 7. This drawing illustrates the general location of the various points of the finished net with respect to the matrix after the net has been formed and pulled so that it is in essentially a flat planar condition.

It will also be apparent that the use of a z loop formed downwardly is merely a convenient way to form the two legs to the proper dimension. The same effect may be achieved by any specific arrangement for the proper leg spacing of the inserted male tension member, for example, a y-orientated loop which is in the same place as the knot loops.

Subsequent to the formation of the net, the net may be immersed or treated with a resin dispersed or dissolved in an aqueous medium in order to provide abrasion resistance to the net itself. Where the tension members are composed of nylon rope or web, or woven nylon tension members as described, in addition to providing abrasion resistance, the treatment in an aqueous medium having dissolved or dispersed a resin therein operates to bring about shrinkage of the net with resultant tightening of each of the knots.

In a preferred form, the tension member is of a diameter sufficiently larger to form a structural net of substantial strength in which each crossing point is knotted and made of rope either of a woven type or of a braided or twisted type or of a suitable webbing. There are, however, advantages which accrue from the use of a woven rope of the type described in the above identified application, in that the tensile strength of the net, on a weight basis is greater with a woven rope than with a twisted or braided rope.

It will be apparent that the above procedure may be utilized with any form of tension member, including flat webbing although it is preferred in accordance with the present invention that rope be used for the reasons already mentioned.

As will be apparent, there are substantial advantages in the formation of structural nets in accordance with the present invention, that is, nets made of rope of 3/16 of an inch in diameter or greater in that each of the knots is hand tied and of a sheet bend variety so that each of the crossing points of the net is fixed without any slippage of the knot relative to the legs connected to the knot. By use of the net making fixture of the present invention it is possible to form nets of virtually any size or shape by proper positioning of the knot forming stations on the matrix and the vertically downwardly depending base portion positioned below the matrix. Since the matrix is arranged in a geometric design corresponding to the geometric pattern of the nets, it is relatively simple to design the net fixture once the overall geometry of the net has been established by utilizing the principles herein described. Again, the manual tying of knots is vastly simplified by the fact that each knot loop is formed by proceeding in sequence such that one need not pull the inserted tension member through each knot as it is made. As described, the inserted tension member which may be the same or different from the tension member forming the knot loops is inserted through each of the formed knot loops, adjusted to provide the vertically downwardly depending loop and thereafter each of the knot loops is tightened in the manner described to provide a completed net.

It will be apparent to those skilled in the art that various modifications may be made to the method and to the apparatus herein described without departing from the present invention as defined in the appended claims.

We claim:

1. A method of forming a knotted net whose main body portion is composed of repeating geometric patterns of crossing tension members knotted at each crossing point comprising the steps of:

arranging in multiple sequential predetermined spatial locations a series of female knot loops in multiple row patterns, and then inserting through each female loop in said multiple row patterns a male tension member and tightening the female loops to form a series of knots each having four legs, the male tension member which is inserted through each female loop being the same tension member used to form the female knot loops.

2. A method as set forth in claim 1 wherein the knots are becket bend knots.

3. A method of forming a net whose main body portion is composed of repeating geometric patterns of crossing tension members knotted at each crossing point comprising the steps of arranging a tension member in a plurality of rows, each row including a plurality of knot loops arranged in two sets in an x-y orientation one set being alternate knot loops in axial alignment in an x direction and offset in a y direction with the knot loops of the other set, the knot loops of the other set being in axial alignment in an x direction, the adjacent rows being disposed such that one set of knot loops is in alignment in an x direction with the knot loops of the adjacent row on one side and the other knot loops are displaced in a y direction and in alignment with the knot loops extending in an x direction, inserting a tension member sequentially through the knot loops which are aligned in an x direction so that the inserted tension member extends in an x direction through each knot loop, and tightening each knot loop to form a knot at those positions when the inserted tension member passes through the knot loop.

4. A method as set forth in claim 3 wherein the tension member which is inserted through the knot loops is the same tension member used to form the knot loops.

5. A method as set forth in claim 3 wherein the tension member which is inserted through the knot loops is a tension member different from the tension member used to form the knot loops.

6. The method as set forth in claim 3 wherein each knot is a sheet bend.

7. The method as set forth in claim 3 wherein each knot loop includes a leading and trailing leg and wherein said inserted tension member includes a leading cross-leg and a trailing-leg, and wherein said step of tightening includes pulling on the leading leg of the knot loop relative to the trailing leg thereof to invert the loop such that the loop is straightened and a loop is formed between the leading and trailing cross-legs.

8. The method as set forth in claim 3 wherein the tension member and the inserted tension member are each composed of nylon strands.

9. The method as set forth in claim 8 wherein the tension members are woven nylon tension members.

10. The method as set forth in claim 9 further including the steps of treating said net with resin in an aqueous medium subsequent to formation of the net.

11. The method as set forth in claim 3 wherein said inserted tension member between adjacent knot loops is moved in a z direction prior to tightening each knot loop.

12. The method as set forth in claim 3 wherein said tension member is inserted through all of said knot loops prior to tightening each knot loop.

13. The method as set forth in claim 3 further including forming unknotted loops peripherally of the knot loops.

14. The method as set forth in claim 13 wherein cargo fittings are assembled to selected unknotted loops.

15. The method as set forth in claim 3 wherein said tension member is rope of a diameter of 3/16 inch and greater.

16. The method as set forth in claim 3 wherein the tension member forms two legs and the knot loop forms the other two legs of a four sided geometric pattern.

17. A net making fixture for forming nets whose main body portion is composed of repeating geometric patterns of crossing tension members knotted at each crossing point comprising means forming a central knot forming matrix including a plurality of knot forming stations arranged in a predetermined pattern, said knot forming stations being arranged in an x-y orientation of rows and columns, alternate columns being arranged in alignment in a y direction and including the same number of knot stations, the knot stations of the rows being in alignment in an x direction, means positioned a predetermined distance below said knot stations and defining a z dimension for forming two of the legs between adjacent knots, and means located peripherally of said knot forming matrix and positioned in a predetermined position relative to selected knot forming stations and defining the unknotted peripheral loop portion of the net formed.

18. A net making fixture as set forth in claim 17 wherein each knot forming station includes a pair of upstanding spaced fingers.

19. A net making fixture as set forth in claim 17 wherein the spacing between adjacent aligned knot stations is less than the dimension of the legs of the geometric pattern of crossing tension members.

20. A net making fixture as set forth in claim 17 wherein said means located peripherally of the knot forming matrix is a predetermined distance from selected knot forming stations to define the length of the peripheral loop formed thereby.

21. A net making fixture as set forth in claim 17 wherein the overall y dimension of the fixture is less than the overall y dimension of the finished net.

22. A net making fixture as set forth in claim 17 wherein the number of knot forming stations equals the number of knots of the main body portion of the finished net.

23. A method of forming a knotted structural net for use in restraining cargo, said net having a main body portion and composed of tension members knotted to form a pattern of knotted tension members comprising the steps of:

forming in a tension member a series of spaced knot loops arranged in a repeating two-dimensional pattern, then inserting the same tension member through each knot loop, and tightening each knot loop to form a knot having four legs.

24. A net making fixture for forming nets whose main body portion is composed of patterns of knots each having four legs comprising; means forming a knot forming matrix having a plurality of knot forming stations, said knot forming stations being arranged in rows and columns, alternate columns being in alignment, the knot stations of the rows being in alignment, means cooperating with the knot stations and positioned relative thereto for defining the length of two of the legs between adjacent knots, and means cooperating with said knot forming stations to form an unknotted peripheral loop portion of the net.

* * * * *